US010944218B2

(12) United States Patent
Lödding

(10) Patent No.: US 10,944,218 B2
(45) Date of Patent: Mar. 9, 2021

(54) OUTER CONDUCTOR ARRANGEMENT

(71) Applicant: Rosenberger Hochfrequenztechnik GmbH & Co. KG, Fridolfing (DE)

(72) Inventor: Thomas Lödding, Traunstein (DE)

(73) Assignee: ROSENBERGER HOCHFREQUENZTECHNIK GMBH & CO. KG, Fridolfing (DE)

( * ) Notice: Subject to any disclaimer, the term of this patent is extended or adjusted under 35 U.S.C. 154(b) by 0 days.

(21) Appl. No.: 16/355,554

(22) Filed: Mar. 15, 2019

(65) Prior Publication Data

US 2019/0288458 A1 Sep. 19, 2019

(30) Foreign Application Priority Data

Mar. 15, 2018 (DE) ..... 10 2018 106 004.1
Feb. 25, 2019 (DE) ..... 10 2019 104 754.4

(51) Int. Cl.
*H01R 13/6581* (2011.01)
*H01R 13/6582* (2011.01)

(52) U.S. Cl.
CPC ..... *H01R 13/6581* (2013.01); *H01R 13/6582* (2013.01)

(58) Field of Classification Search
CPC ..... H01R 13/6593; H01R 13/6581; H01R 13/6582
See application file for complete search history.

(56) References Cited

U.S. PATENT DOCUMENTS 4,423,919 A * 1/1984 Hillis ..... H01R 13/6582 439/607.17
5,588,851 A * 12/1996 Morlion ..... H01R 13/6586 439/108
6,337,448 B1 * 1/2002 Konda ..... H01H 9/085 200/17 R
6,406,330 B2 * 6/2002 Bruce ..... H01R 13/6277 439/578
7,018,237 B2 * 3/2006 Zhan ..... H01R 12/716 439/607.55
7,597,590 B2 * 10/2009 McColloch ..... G02B 6/4201 439/607.18

(Continued)

FOREIGN PATENT DOCUMENTS

DE 43 12 641 C2 10/1994
DE 202013001452 U1 3/2013

(Continued)

OTHER PUBLICATIONS

Machine English translation of German Search Report issued in German Application No. 10 2018 106 004.1 dated Nov. 6, 2018.

(Continued)

*Primary Examiner* — Briggitte R. Hammond
(74) *Attorney, Agent, or Firm* — Fay Sharpe LLP

(57) ABSTRACT

The present invention relates to an outer conductor arrangement for a connector, having an outer conductor base body and an outer conductor ring, wherein the outer conductor base body has a plurality of contact lugs, wherein the outer conductor ring is mounted on an interface-side end of the outer conductor base body, has at least one protrusion or recess and has a closed structure, wherein the outer conductor ring is designed to protect the contact lugs from mechanical force influences.

11 Claims, 3 Drawing Sheets

(56) References Cited

U.S. PATENT DOCUMENTS

| | | | | |
|---|---|---|---|---|
| 8,033,741 | B2 * | 10/2011 | Yoshikawa | G02B 6/4201 385/92 |
| 8,052,467 | B1 * | 11/2011 | Xie | H01R 13/6594 439/589 |
| 8,353,722 | B1 * | 1/2013 | Lan | H01R 25/006 439/607.35 |
| 8,742,266 | B2 * | 6/2014 | Feldstein | H01R 13/6596 174/355 |
| 8,777,670 | B2 * | 7/2014 | Blakborn | H01R 31/06 439/638 |
| 8,911,256 | B2 * | 12/2014 | Qiao | H01R 13/6581 439/607.18 |
| 9,011,186 | B2 * | 4/2015 | Wirth | H01R 13/11 439/852 |
| 9,666,992 | B2 * | 5/2017 | Cox | H01R 13/5841 |
| 2008/0188119 | A1 * | 8/2008 | Okamura | H01R 13/625 439/445 |
| 2014/0187105 | A1 * | 7/2014 | Zhao | H01R 12/707 439/733.1 |
| 2014/0364013 | A1 * | 12/2014 | Yu | H01R 13/193 439/660 |

FOREIGN PATENT DOCUMENTS

| | | | |
|---|---|---|---|
| DE | 10 2016109266 | A1 | 11/2017 |
| EP | 0476848 | A1 | 3/1992 |
| EP | 0967684 | A2 | 12/1999 |
| EP | 3396791 | A1 | 10/2018 |
| WO | WO 2018/099904 | A1 | 6/2018 |

OTHER PUBLICATIONS

German Office Action issued in Application No. 10 2019 104 754.4 dated Oct. 30, 2019, with English Google Translation, 16 pages.

Office Action for related European Patent Application No. 19 160 510.4-1201, dated Jun. 2, 2020, with English Google generated Machine Translation, 10 pages.

Third Party Observation, filing No. 102019104754.4, entered Nov. 20, 2020 and English translation thereof.

* cited by examiner

OUTER CONDUCTOR ARRANGEMENT

CROSS REFERENCE TO RELATED APPLICATIONS

The present application claims priority to German Patent Application No. 10 2018 106 004.1 filed Mar. 15, 2018, and German Patent Application 10 2019 104 754.4 filed Feb. 25, 2019, the contents of which are hereby incorporated by reference in their entirety.

FIELD OF THE INVENTION

The present invention relates to an outer conductor arrangement and a production method for an outer conductor arrangement.

TECHNICAL BACKGROUND

Connectors, both with an open entry and with a closed entry, are known, for example, from the "PosiBand" connector by Positronic.

A connector with an open entry is shown in FIG. 3. Such connectors have an interface-side front edge, which is not circumferentially closed. Interruptions in the front edge are generally formed by contact lugs. Connectors with an open entry are better able to compensate manufacturing tolerances and reduce the mating forces required for mating purposes.

A connector with a closed entry is shown in FIG. 4. Such connectors have a closed interface-side front edge. Contact lugs can be surrounded by a housing. Connectors with a closed entry prevent the connector from becoming damaged by mechanical force influences, for example as a result of attempting mating with an incorrect mating connector. They also result in considerably higher mating forces.

Attempts in the prior art demonstrate that the optimization of one of the parameters involving EMC tightness, mating forces and stability and impedance optimization of a connector in the high frequency range are mutually conflicting. This can be seen, for example, in existing products by the applicant, Rosenberger Hoch-frequenztechnik GmbH & Co. KG. FIG. 5 shows such a product.

An outer conductor 90 of a high-voltage (HV) connector, which is designed for frequencies in the megahertz range, is illustrated in FIG. 5. The outer conductor comprises a closed entry 91 and spring-loaded contact lugs 92 with contact points 93 which are located behind the closed entry. Depending on the frequency, resonances occur at the outer conductor due to capacitances between the mating partners. Although the above-mentioned disadvantages are not yet apparent in this frequency range, there is still the need to produce an outer conductor which is suitable for a connector in a higher frequency range.

US 20140364013 A1 and DE 202013001452 U1 disclose an outer conductor arrangement for a connector, having an outer conductor base body and an outer conductor ring, wherein the outer conductor base body has a plurality of contact lugs, wherein the outer conductor ring adjoins an interface-side end of the outer conductor base body, is fastened to the outer conductor base body in at least one fastening region by means of a retaining lug and has a closed structure to form a closed entry of the outer conductor arrangement, wherein contact lugs are provided which are not fastened to the outer conductor ring.

This is a state which should be improved.

SUMMARY OF THE INVENTION

Against this background, the present invention is based on the object of providing a connector with a closed entry and improved impedance properties.

According to the invention, this object is achieved by an outer conductor arrangement having the features of claim 1.

The idea forming the basis of the present invention consists in arranging ends of contact lugs of an outer conductor behind an outer conductor ring such that the contact lugs are flexibly deformable to ensure low mating forces and, at the same time, to create a closed entry by means of an outer conductor ring.

Accordingly, the contact lugs which are not fastened to the outer conductor ring have the same tolerance-compensating properties as the contact lugs according to FIG. 3.

In this patent application, a ring is understood to mean a circumferential object. Its cross-sectional area can be, inter alia, circular, oval, elliptical or the like.

According to the invention, the outer conductor arrangement has an inward jump in diameter between the outer conductor base body and the outer conductor ring. Jumps in the diameter of the outer conductor enable an adjustment of the impedance.

Advantageous configurations and further developments are revealed in the further subclaims and in the description with reference to the figures of the drawing.

It goes without saying that the features which are mentioned above and those which are still to be explained below can be applied not only in the combination described in each case but also in other combinations or in isolation without deviating from the scope of the present invention.

In particular, it can be provided that the outer conductor ring does not have a protrusion or recess.

According to a further preferred embodiment of the invention, the outer conductor ring is designed to protect contact lugs from mechanical force influences. This is necessary if a connector is to also be mateable from an angled direction or is to withstand force effects from an angled direction in the mated state without damage to the outer conductor. According to an embodiment of the present invention, this protection of the contact lugs can be ensured by a closed entry of the outer conductor.

This embodiment of the present invention therefore solves the problem of reducing mating forces and, at the same time, increasing the stability of a connector. However, in practice, the optimization of these two properties is contradictory, i.e. a desired increase in the stability results in an undesired increase in the mating forces and vice versa.

According to a further preferred embodiment of the invention, at least one contact lug is formed as a retaining lug to which the outer conductor ring is connected. The outer conductor ring can thus be mounted on the outer conductor base body in a particularly simple and secure manner.

Alternatively, it is also possible to mount the outer conductor ring on another part of the outer conductor. In particular, the retaining lug does not necessarily have to be a contact lug. A contact lug serves for establishing contact with a mating connector to which a connector having the outer conductor arrangement is to be connected.

If contact lugs are only fastened to the outer conductor base body, they have spring-loaded properties. The retaining lugs can be provided in such a way that their rigidity is greater than the rigidity of the contact lugs which are not fastened.

If the outer conductor ring is fastened to a plurality of lugs, in particular to two lugs on the outer conductor base body, it has a lower spring capacity than the contact lugs which are not fastened to the outer conductor ring.

It is advantageous if a main extent direction of the retaining lug extends in the circumferential direction of the outer conductor retaining ring and/or if the main extent direction of the retaining lug extends perpendicularly to the main extent direction of the contact lugs.

The connector according to the invention is particularly advantageous in that it can also be manufactured by a punching method including the jumps in diameter.

If a connector according to the invention is manufactured by means of a punching method, jumps in the diameter of the retaining lugs can be generated.

According to a further preferred embodiment of the invention, the outer conductor ring is connected to the outer conductor base body by means of a joining method, e.g. by means of welding. Alternatively, the outer conductor ring and the outer conductor base body can be manufactured from a cohesive part.

According to a further preferred embodiment of the invention, the outer conductor base body has two retaining lugs. The retaining lugs can be linear or curved.

In this case, it is further expedient if a spring-loaded contact lug is provided in the retaining lug.

According to a preferred embodiment, the outer conductor ring has a protective collar, which protrudes in the radial direction with respect to free ends of the contact lugs, wherein the protective collar is designed to protect the contact lugs of the outer conductor base body from mechanical force effects. In this case, it can be provided that the protective collar prevents the contact lugs from becoming damaged by inserted objects, for example tools. In one embodiment, the protective collar can be formed as a perpendicular wall which projects from the outer conductor ring, or as a curved lug which covers the front ends of the contact lugs.

According to a further preferred embodiment, the contact lugs each have a raised contact point for establishing contact with a mating connector. The contact lugs are therefore subject to prestress in the mated state, whereby the contact is improved. The shielding of the connector is thus improved. To reduce mating forces, it is possible to arrange these contact points such that they are offset in the axial direction.

According to a further preferred embodiment, the outer conductor ring and the outer conductor base body are formed as one part.

According to a further preferred embodiment of the invention, the outer conductor base body is formed as a punched part. Punched parts can be produced in a particularly cost-effective manner. In particular, the production of punched parts can take place in a highly automated manner. However, for connectors with a closed entry, the generation of jumps in diameter in punching methods is only possible in association with other mechanical disadvantages, such as high mating forces or low contact forces.

Where useful, the above configurations and further developments can be combined with one another as required. Further possible configurations, further developments and implementations of the invention also include combinations, not explicitly mentioned, of features of the invention which are described above or below with reference to the exemplary embodiments. In particular, in this case, the person skilled in the art will add individual aspects as improvements or modifications to the respective basic form of the present invention.

BRIEF DESCRIPTION OF THE DRAWINGS

The present invention will be explained in more detail below with reference to the exemplary embodiments illustrated in the schematic figures of the drawing, which shows.

Figure 1:
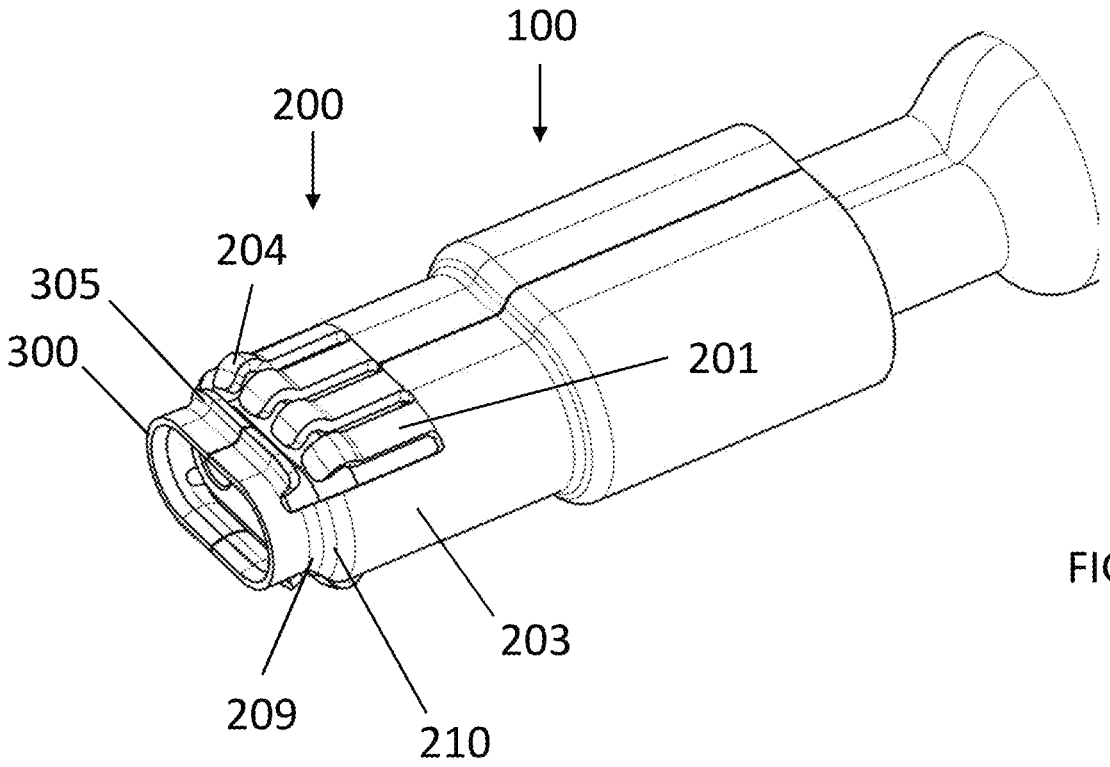
FIG. 1 is a schematic perspective view of an outer conductor arrangement according to an embodiment of the invention.

The accompanying figures of the drawing are intended to impart further understanding of the embodiments of the invention. They clarify embodiments and, in conjunction with the description, serve to explain principles and concepts of the invention. Other embodiments and many of the said advantages are revealed with reference to the drawings. The elements of the drawings are not necessarily shown true to scale in relation to one another.

In the figures of the drawing, identical, functionally identical and identically acting elements, features and components—unless stated otherwise—are each denoted by the same reference signs.

The figures are cohesively and comprehensively described below.

DESCRIPTION OF EXEMPLARY EMBODIMENTS

FIG. 1 shows a schematic view of an outer conductor arrangement 100 according to the invention in a non-assembled state. The outer conductor arrangement 100 according to the invention comprises the outer conductor base body 200 and the outer conductor ring 300. The outer conductor arrangement 100 is formed to receive one or more inner conductors and one or more insulator parts to provide a coaxial, twinaxial or triaxial connector.

The outer conductor base body 200 comprises a plurality of contact lugs 201 on its upper side and underside and a respective retaining lug, formed as a contact lug 203, on the right and left side. The contact lug 203 is somewhat larger than the contact lugs 201 and therefore also more rigid than the contact lugs 201. The outer conductor ring 300 is moreover integrally formed on the contact lugs 203, which additionally contributes to an increased rigidity of the contact lugs 203 with respect to the contact lugs 201. The retaining lug 203 has a fastening region 210 to which the outer conductor ring 300 is fastened.

Figure 6:
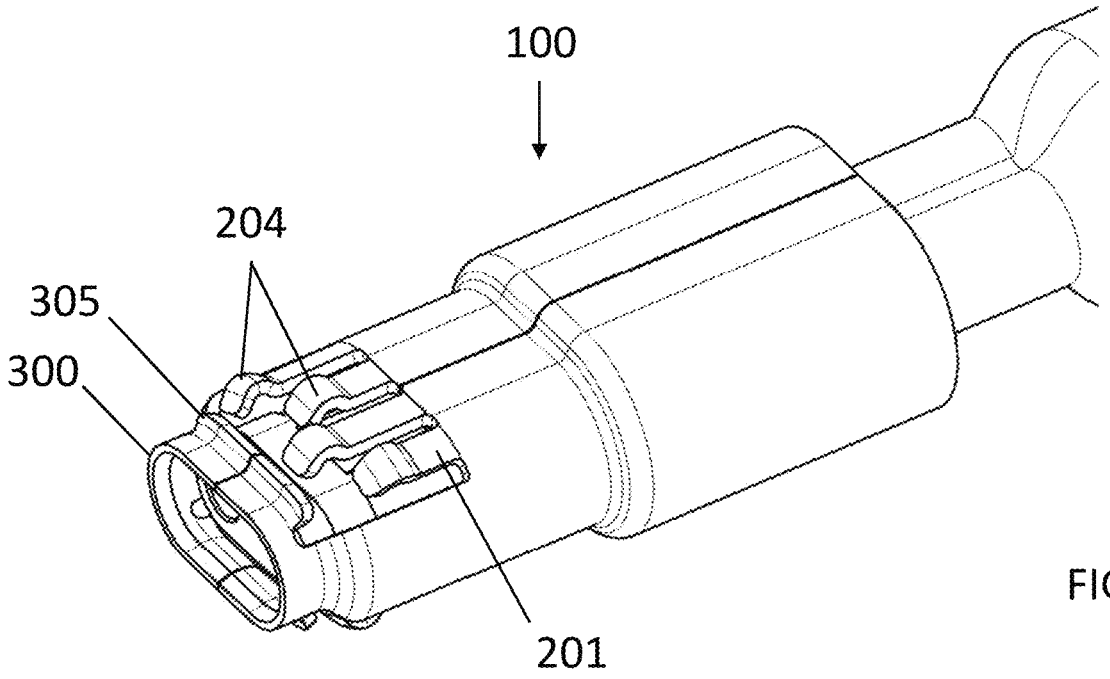
FIG. 6 is a schematic perspective view of an outer conductor arrangement according to an embodiment of the invention where the contact points are formed offset from one another in an axial direction of the outer conductor base body.

The contact lugs 201 each have a contact point 204 in a front end region. The contact point is formed as a raised portion on the contact lugs 201 and, in the mated state, establishes contact with the outer conductor of a mating plug connector which is mated with the outer conductor arrangement 100. This ensures an electromagnetic shielding at the upper and underside of the outer conductor arrangement 100 of inner conductors (not illustrated) guided through the outer conductor base body 200 within the outer conductor base body 200. The contact points can be formed offset from one another in an axial direction of the outer conductor base body, as seen in FIG. 6.

Figure 2:
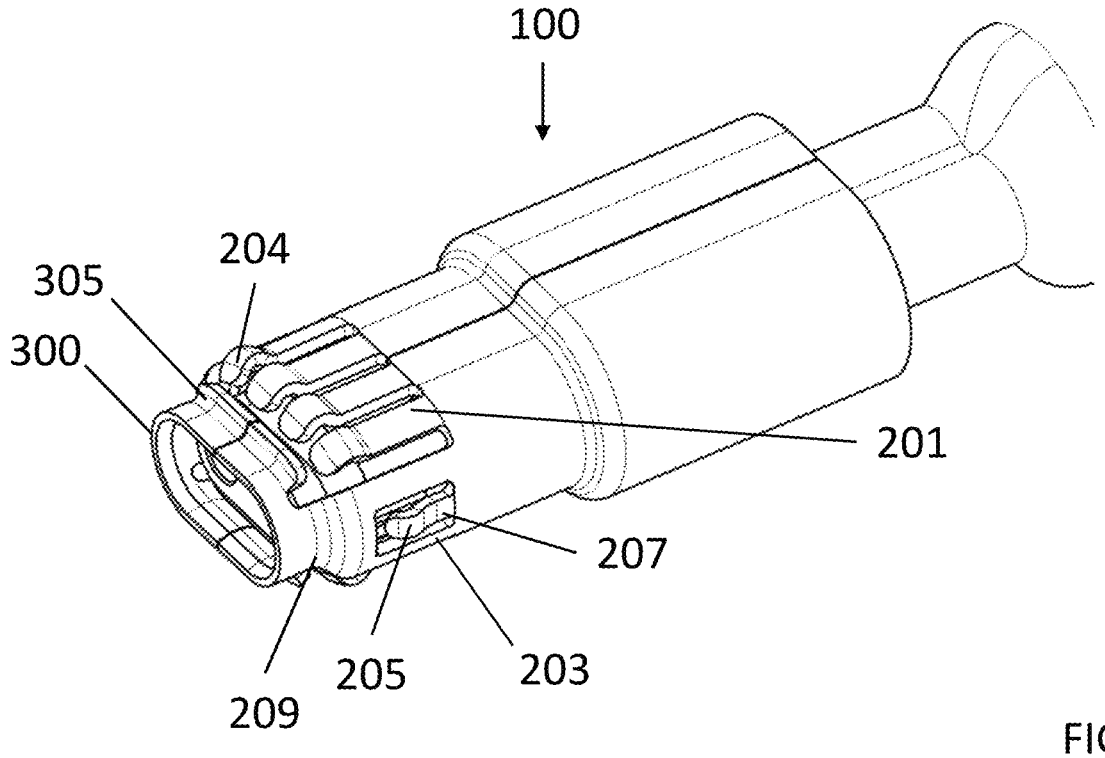
FIG. 2 is a schematic perspective view of an outer conductor arrangement according to an embodiment of the invention.
Figure 3:
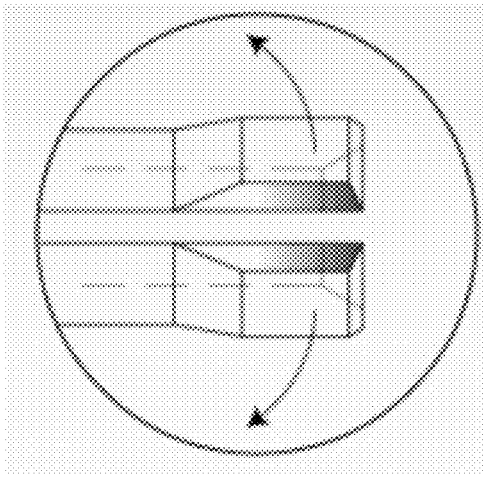
FIG. 3 PRIOR ART
FIG. 3 is a schematic view of the prior art.
Figure 4:
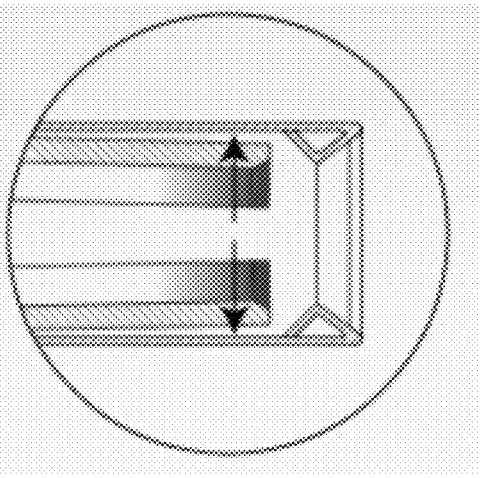
FIG. 4 PRIOR ART
FIG. 4 is a schematic view of the prior art.
Figure 5:
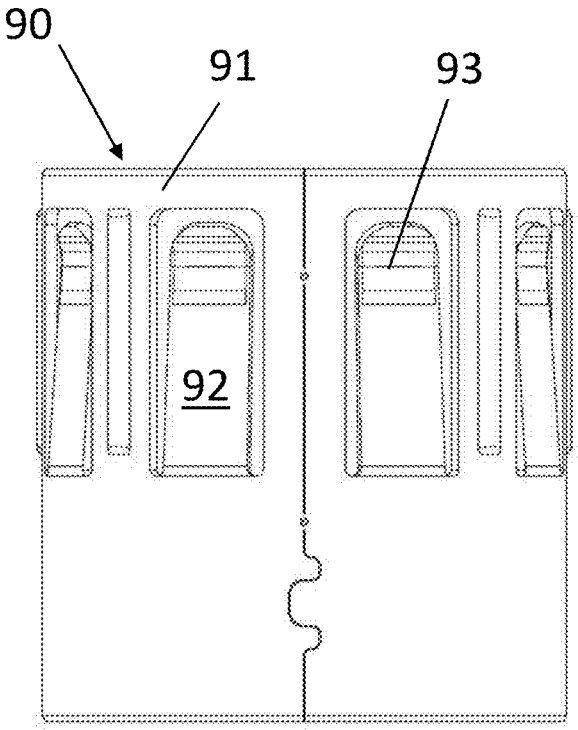
FIG. 5 PRIOR ART
FIG. 5 is a schematic view of the prior art.

In FIG. 2, the contact lugs 203 also each have a contact point 205. The contact point 205 is formed on a spring lug 207 in the contact lug 203. It is thus ensured that the outer conductor arrangement 100 also provides electro-magnetic shielding at the sides of the outer conductor arrangement.

It can be seen in FIG. 1 that the outer conductor base body 200 provides a jump in diameter between the contact lugs 201, 203 and the outer conductor ring 300.

Figure 7:
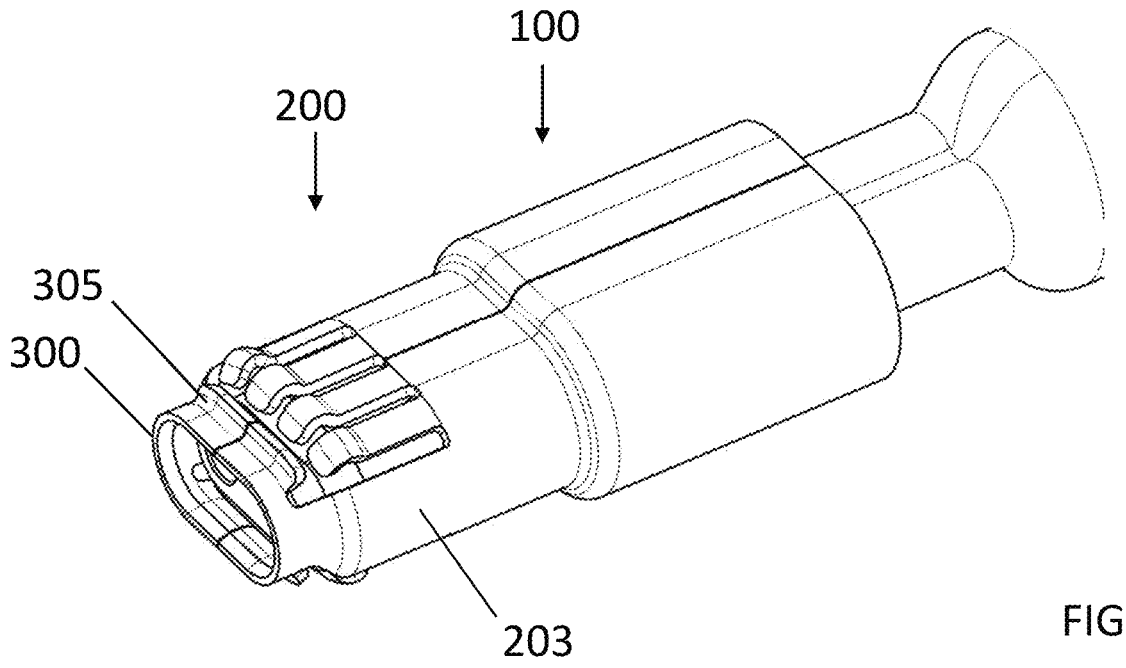
FIG. 7 is a schematic perspective view of an outer conductor arrangement according to an embodiment of the invention where the outer conductor base body and the outer conductor ring are formed as one part.

In FIG. 1, the outer conductor ring 300 is connected to the outer conductor base body 200 via a welded seam 209. Alternatively, the outer conductor base body 200 and the outer conductor ring 300 can be formed as one part, as seen in FIG. 7.

The outer conductor ring 300 comprises the protective collar 305, which protects the ends of the contact lugs 201 from a force effect caused by foreign bodies.

Although the present invention has been fully described above with reference to preferred exemplary embodiments, it is not restricted to these and can instead be modified in a variety of ways.

LIST OF REFERENCE SIGNS

100 Outer conductor arrangement
200 Outer conductor base body
201 Contact lugs
203 Contact lugs
204 Contact point
205 Contact point
207 Spring lug
300 Outer conductor ring
305 Protective collar

The invention claimed is:

1. Outer conductor arrangement for a connector, having an outer conductor base body and an outer conductor ring, wherein the outer conductor base body has a plurality of contact lugs, wherein the outer conductor ring is axially displaced from and adjoins an interface-side end of the outer conductor base body, is joined with the outer conductor base body by means of a retaining lug and has a closed structure to form a closed entry of the outer conductor arrangement, wherein the contact lugs are not fastened to the outer conductor ring, wherein a jump in diameter is formed between the outer conductor ring and the outer conductor base body, wherein the diameter of the outer conductor base body is greater than the diameter of the outer conductor ring.

2. Outer conductor arrangement according to claim 1, wherein the outer conductor ring is designed to protect the contact lugs from mechanical force influences.

3. Outer conductor arrangement according to claim 1, wherein the retaining lug has a fastening region to which the outer conductor ring is fastened.

4. Outer conductor arrangement according to claim 3, wherein the outer conductor ring is connected to the retaining lug by a welded seam.

5. Outer conductor arrangement according to claim 3, wherein the outer conductor base body has at least two retaining lugs.

6. Outer conductor arrangement according to claim 1, wherein the retaining lug is a spring lug.

7. Outer conductor arrangement according to claim 1, wherein the outer conductor ring has a protective collar, which protrudes in the radial direction with respect to free ends of the contact lugs.

8. Outer conductor arrangement according to claim 1, wherein the contact lugs each have a raised contact point for establishing contact with a mating connector to be connected to the connector.

9. Outer conductor arrangement according to claim 8, wherein the contact points are formed offset from one another in an axial direction of the outer conductor base body.

10. Outer conductor arrangement according to claim 1, wherein the outer conductor base body and/or the outer conductor ring are formed as a punched part.

11. Outer conductor arrangement according to claim 1, wherein the outer conductor base body and the outer conductor ring are formed as one part.

* * * * *